US008488822B2

(12) United States Patent
Klemmensen

(10) Patent No.: US 8,488,822 B2
(45) Date of Patent: Jul. 16, 2013

(54) ASSISTIVE LISTENING SYSTEM ADAPTED FOR USING DECT

(75) Inventor: Bjarne Klemmensen, Smørum (DK)

(73) Assignee: Oticon, Smorum (DK)

( * ) Notice: Subject to any disclaimer, the term of this patent is extended or adjusted under 35 U.S.C. 154(b) by 196 days.

(21) Appl. No.: 12/970,467

(22) Filed: Dec. 16, 2010

(65) Prior Publication Data

US 2011/0150249 A1 Jun. 23, 2011

Related U.S. Application Data

(60) Provisional application No. 61/287,219, filed on Dec. 17, 2009.

(30) Foreign Application Priority Data

Dec. 17, 2009 (EP) ..... 09179613

(51) Int. Cl.
*H04R 25/00* (2006.01)

(52) U.S. Cl.
USPC ..... 381/315; 381/312; 381/314; 381/79

(58) Field of Classification Search
USPC ..... 381/77–79, 315
See application file for complete search history.

(56) References Cited

U.S. PATENT DOCUMENTS 6,397,037 B1 5/2002 Franklin et al.
7,680,292 B2 * 3/2010 Warren et al. ..... 381/322
8,169,938 B2 * 5/2012 Duchscher et al. ..... 370/310
2001/0014133 A1 * 8/2001 Taverdet ..... 375/354
(Continued)

FOREIGN PATENT DOCUMENTS

WO WO 2005/032109 A1 4/2005
WO WO 2006/074692 A1 7/2006
WO WO 2007/005199 A2 1/2007
WO WO 2007/046748 A1 4/2007
(Continued)

OTHER PUBLICATIONS

"Digital Enhanced Cordless Telecommunications (DECT)"; Common Interface (CI); Part 1: Overview; ETSI EN 300 175-1, (2008).

*Primary Examiner* — Curtis Kuntz
*Assistant Examiner* — Ryan Robinson
(74) *Attorney, Agent, or Firm* — Birch, Stewart, Kolasch & Birch, LLP

(57) ABSTRACT

The invention relates to an assistive listening system comprising an audio transmitting device adapted for transmitting an audio signal and/or a control signal to a multitude of receiving listening devices and at least one receiving listening device adapted for receiving said audio signal and said control signal from said audio transmitting device. The invention further relates to a method of operating an assistive listening system and to its use. The object of the present invention is to provide an assistive listening system suitable for servicing a multitude of body worn listening devices in a wireless environment. The problem is solved in that the system is adapted to establish a digital link according to the DECT-standard from the audio transmitting device to the at least one receiving listening device, wherein the system is adapted to provide that said link is uni-directional. The system has the advantage of providing a reliable channel selection in a wireless assistive listening system comprising low power, body worn listening devices. The invention may e.g. be used for public address systems, e.g. educational listening systems, comprising listening devices adapted for being worn by a user.

20 Claims, 7 Drawing Sheets

U.S. PATENT DOCUMENTS

| | | | | |
|---|---|---|---|---|
| 2005/0255843 | A1 | 11/2005 | Hilpisch et al. | |
| 2006/0253279 | A1* | 11/2006 | Sung | 704/221 |
| 2007/0223725 | A1* | 9/2007 | Neumann et al. | 381/80 |
| 2010/0054512 | A1* | 3/2010 | Solum | 381/315 |
| 2012/0114158 | A1* | 5/2012 | Gysin | 381/315 |

FOREIGN PATENT DOCUMENTS

| | | | |
|---|---|---|---|
| WO | WO 2007/140403 | A2 | 12/2007 |
| WO | WO 2008/125291 | A2 | 10/2008 |
| WO | WO 2009/118424 | A2 | 10/2009 |

* cited by examiner

FIG. 4
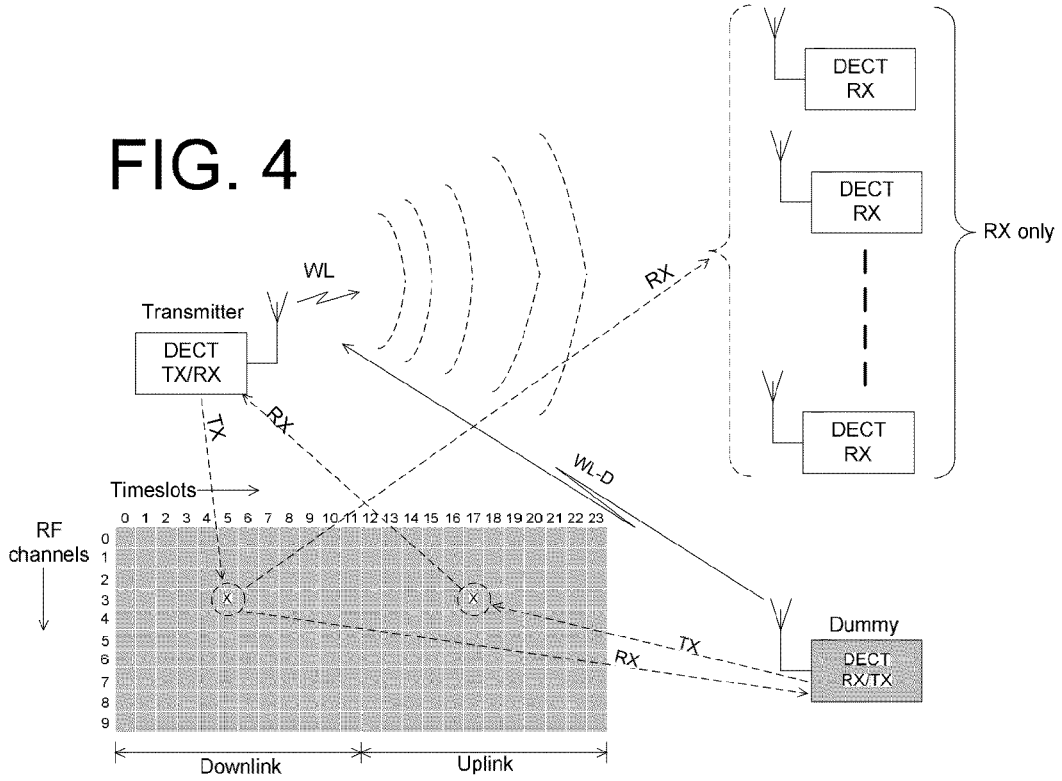
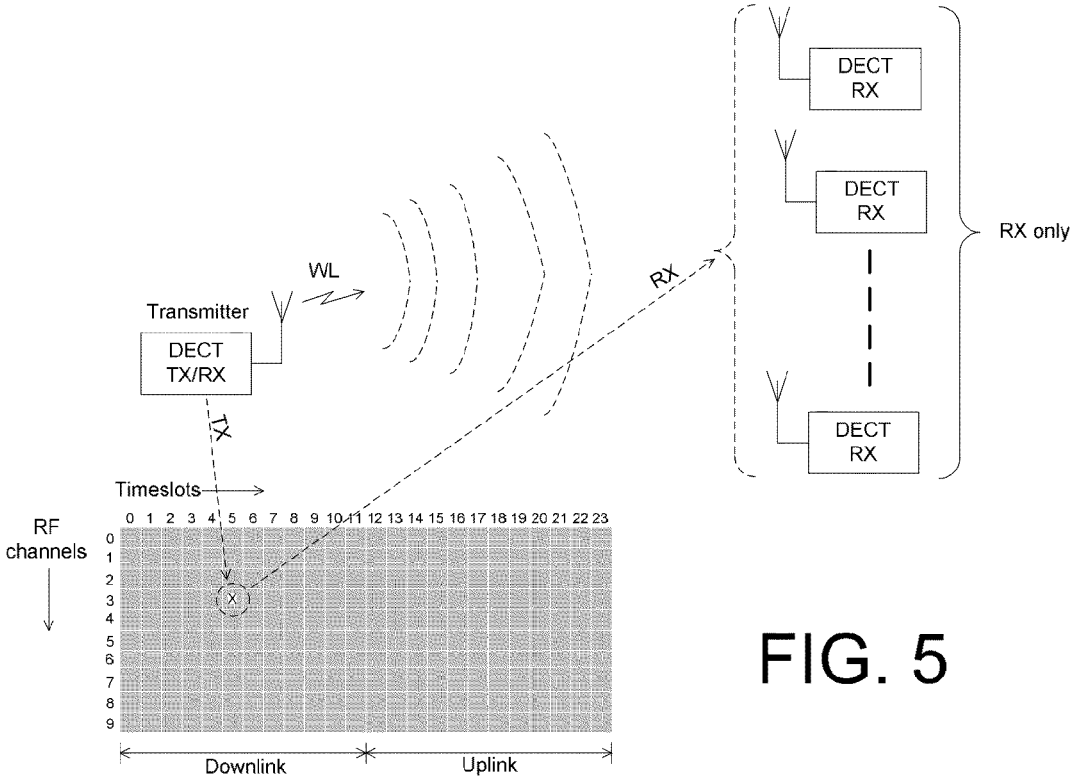
FIG. 5

FIG. 6
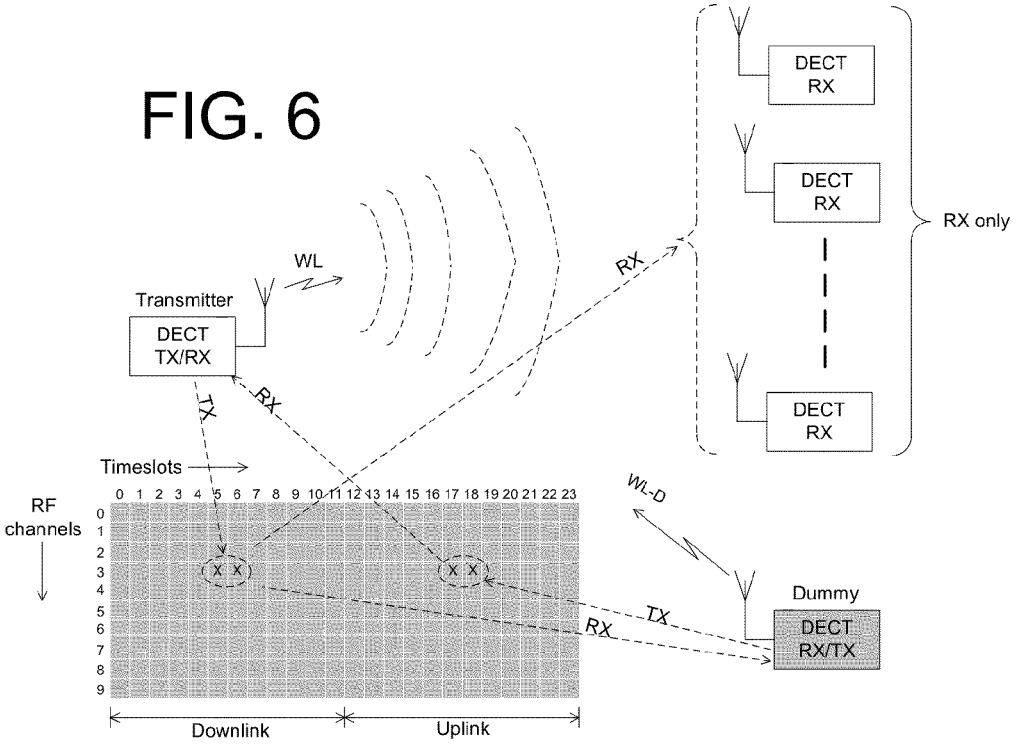
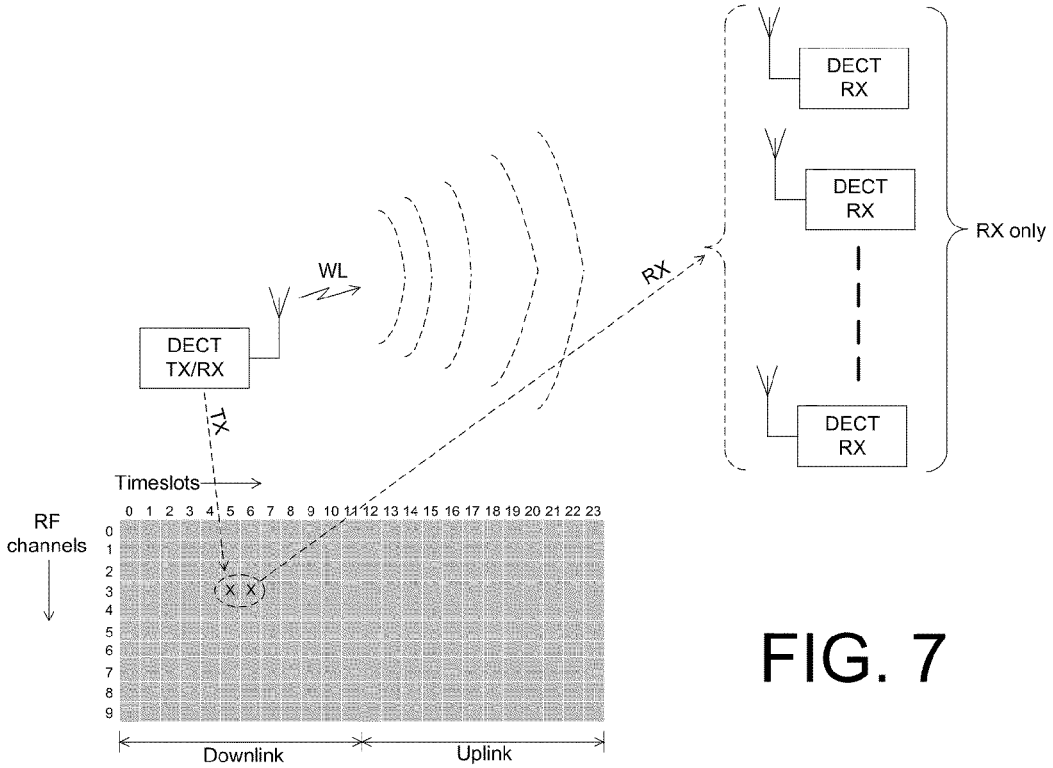
FIG. 7

ASSISTIVE LISTENING SYSTEM ADAPTED FOR USING DECT

CROSS REFERENCE TO RELATED APPLICATIONS

This non provisional application claims the benefit of U.S. Provisional Application No. 61/287,219 filed on Dec. 17, 2009 and to patent application Ser. No. EP 09179613.6 filed in European patent Office, on Dec. 17, 2009. The entire contents of all of the above applications is hereby incorporated by reference.

TECHNICAL FIELD

The present invention relates to wireless transmission in an assistive listening system. The invention relates specifically to an assistive listening system comprising an audio transmitting device adapted for transmitting an audio signal and/or a control signal to a multitude of receiving listening devices and at least one receiving listening device adapted for receiving said audio signal and said control signal from said audio transmitting device.

The invention furthermore relates to a method of operating an assistive listening system, and to a data processing system comprising a processor and program code means for causing the processor to perform at least some of the steps of the method and to a computer readable medium storing the program code means. The invention furthermore relates to the use of an assistive listening system.

The invention may e.g. be useful in applications such as public address systems, e.g. educational listening systems, comprising listening devices adapted for being worn by a user.

BACKGROUND ART

Traditionally wireless Radio Frequency (RF) Assistive Listening Devices (ALD) have utilized narrow band analogue Frequency Modulation (FM) as the wireless technology for aiding one or more listeners in receiving an audio signal from an audio source (e.g. a talker/speaker). A wireless ALD system consists for example of a microphone used by a speaker for picking up a sound signal from the speaker and comprising a transmitter for wirelessly transmitting the acoustic signal and a receiver used by a listener for receiving the wireless signal. The receiver is adapted to transmit the sound signal to a part of a listening device (e.g. of a hearing aid) worn at or in an ear of the listener/user, e.g. either through a direct audio input to the ear worn part or through a wireless link to the ear worn part, e.g. provided using a looped cord worn around the neck of the user and a corresponding inductive receiver in the ear worn part of the listening device.

Wireless ALD systems are useful in a variety of situations or venues such as theatres, places of worship, museums, public meeting places, corporate conference rooms, convention centres, other large areas for gathering listening, during classroom lectures, in a restaurant, at meetings, at hospitals, senior centres etc.

Narrow band analogue FM based ALD systems have several limitations, however, some of which are 1. Limited audio dynamic range, due to bandwidth limits in the RF channel and thereby limitation in the FM frequency deviation—maximum audio SNR is approximately 50 dB.
2. Limited number of RF channels for high density areas—limited RF spectrum for wireless ALDs in some countries. The available spectrum is different in almost every country and the amount of spectrum is usually limited to between 0.2 MHz and 2 MHz. The available frequencies are clustered around 169 MHz (Japan, Denmark), 174-176 MHz (most of Europe, S. Africa, Brazil, Hong Kong, Australia), 180-186 MHz (Denmark, France, Belgium, Singapore) and 216-217 MHz (USA, Canada, Taiwan, Korea). Also new frequencies (169.4-169.6 MHz) are in the process of being released for exclusive use in European countries.
3. Limited distance or range between transmitter and receiver—due to limits in maximum allowed RF Transmit (TX) power.

Typical maximum allowable transmission power levels for three analogue narrow band FM ALD frequency bands are shown in the table below:

| Band | Level |
|---|---|
| 173 MHz | 2 mW ∝ 3 dBm radiated |
| 183 MHz | 10 mW ∝ 10 dBm radiated |
| 216 MHz | 100 mW ∝ 20 dBm radiated |

To overcome the limited audio quality of maximum 50 dB SNR in analogue narrow band FM systems, a shift to a digital modulation based system could be considered. Unfortunately the use of digital modulation schemes is not free of problems e.g.:

1. A lack of dedicated universal or close to universal frequency bands for hearing impaired ALD applications utilizing digital modulation schemes.
2. Limits on TX power before frequency hopping must be implemented.
3. Has to coexist with other unknown systems/applications in the same frequency band/spectrum.

U.S. Pat. No. 6,397,037 B1 describes an RF-type amplification system, such as a classroom amplification system, employing technology (e.g. digital technology) adapted from a cordless telephone system to overcome interference. WO 2006/074692 A1 describes a hearing aid comprising an earpiece unit to be placed in or at a user's ear, the ear piece comprising a microphone unit and a loudspeaker unit and a wireless interface, the hearing aid further comprising a body worn amplifying device adapted to amplify electrical signals received from the microphone unit to deliver the amplified electrical signals to the loudspeaker unit. The wireless interface can e.g. be based on Bluetooth, DECT or other digital standards. WO 2009/118424 A2 describes a hearing assistance system comprising a transmission unit comprising a microphone arrangement for capturing audio signals from a speaker's voice and means for transmitting audio signals via a wireless audio link; at least one receiver unit for receiving audio signals from the transmission unit via the wireless audio link, the receiver unit comprising a speech quality indicator unit comprising means for assessing the speech quality of the received audio signals and means for providing a signal representative of the assessed speech quality; means for stimulating a user's hearing according to the audio signals received by the receiver unit; and means for providing an alarm signal if the assessed speech quality is below a predefined threshold value. The alarm signal is e.g. transmitted from the receiver unit to the transmitter unit via a (separate) assistive digital link.

An ALD application based for example on Bluetooth transmission, e.g. used in a public address system, e.g. a classroom amplification system, is not feasible because it is peer to peer based.

Further, in body worn listening devices comprising a local source of energy (e.g. a battery) and in particular in ear worn devices due to their small size (and corresponding small space for a power source), low power consumption is a major issue.

DISCLOSURE OF INVENTION

A solution to at least some of the above problems is to utilize the DECT technology (DECT=Digital Enhanced Cordless Telecommunications) in digital modulation ALD receivers associated with or forming part of a listening device (e.g. a hearing instrument) located at the ear, in the ear or in the ear canal of a user. The term 'listening device' is taken to include hearing instruments, active ear plugs, ear phones and headsets and combinations thereof. The term 'hearing instrument' is taken to include body worn devices that are adapted to compensate a users' hearing impairment, e.g. a hearing instrument comprising a speaker/receiver as output transducer, Bone Anchored Hearing Aids (Baha) as well as Cochlear Implant (CI) sound processors. A listening device, e.g. a hearing instrument, typically comprises an input transducer and/or an interface for providing a direct electric input comprising an audio signal and an output transducer, a forward path being defined between the input transducer/direct electric interface and the output transducer. The forward path typically comprises a signal processing unit for processing an audio input signal and providing a processed output signal to the output transducer. Other functionality may be included depending on the practical application of the device, e.g. an anti feedback system for minimizing the effect of acoustic feedback from the output transducer to the input transducer, and/or a selector/mixer for selecting one of or a weighted mixture of two inputs (e.g. from a microphone and a direct electric input) for the further processing of the signal path (if any, so that one of the inputs or a mixture can be presented to a user via the output transducer). An assistive learning system according to the present application comprises a transmitter of a wireless signal according to the DECT standard (the wireless signal comprising a sound signal from an audio source), and one or more listening devices for receiving the wireless signal and extracting the sound signal. Optionally the system comprises a body worn (intermediate) receiver unit for receiving the wireless signal from the DECT transmitter and for extracting/relaying/transmitting the sound signal to a listening device worn by the same person. The DECT transmission is one-way (audio) from the transmitter (e.g. comprising an audio signal from a microphone, a TV-set, a radio, a PC, an MP3-player, a mobile phone, the Internet or a dedicated basis station, e.g. a gateway for a number of (e.g. selectable) audio signals) to a receiver unit of the listening device(s). There is thus no DECT transmission from the listening device during normal speech/audio transmission from the DECT transmitter, see FIG. 1.

An object of the present application is to provide an assistive listening system suitable for servicing a multitude of body worn listening devices in a wireless environment.

Objects of the application are achieved by the invention described in the accompanying claims and as described in the following.

An Assistive Listening System:

An object of the application is achieved by an assistive listening system comprising an audio transmitting device adapted for transmitting an audio signal and/or a control signal to a multitude of receiving listening devices and at least one receiving listening device adapted for receiving said audio signal and said control signal from said audio transmitting device, wherein the system is adapted to establish a digital link according to the DECT-standard from the audio transmitting device to the at least one receiving listening device, wherein the system is adapted to provide that said link is uni-directional.

The system has the advantage of providing a reliable channel selection in a wireless assistive listening system comprising low power, body worn listening devices.

The assistive listening system is adapted to provide that the DECT link from the transmitting device to the receiving listening device is uni-directional. The term 'uni-directional link' is intended to mean 'providing one-way transmission' (here from the DECT transmitter to the receiving listening device). This has the advantage that no transmission from the receiving listening device is needed (which on the other hand allows a reduction of receiver complexity and power consumption). Further, it facilitates broadcasting from a transmitter to a multitude of receiving listening devices in the same time slot of the DECT map.

The transmitted signal typically comprises an audio signal and a control signal. The audio signal is an electric signal representing a signal in the human audible frequency range (e.g. 20 Hz to 20 kHz or a sub-range thereof). The control signal is a signal comprising information of relevance to transmission and/or reception, e.g. synchronization, channel/slot, authentication, etc.

In an embodiment, the transmitted signal, comprising an audio signal and a control signal, is transmitted (from the transmitting device to the receiving listening device) via the uni-directional link according to the DECT-standard.

In an embodiment, the audio transmitting device comprises a DECT transmitter. In an embodiment, the audio transmitting device comprises a DECT transceiver (i.e. a DECT transmitter and a DECT receiver). In an embodiment, the at least one receiving listening device comprises a DECT receiver. A 'DECT transmitter' is in the present context taken to mean such transmitters that comply with the DECT standard as described in the ETSI EN 300 175-1 standard for DECT (and underlying related documents), including allowable proprietary changes as described in Chapter 8 and allowing a DECT transmitter to disregard or not require any feedback response from a DECT receiver. A 'DECT receiver' is in the present context taken to mean such receivers that are able to receive and decode/understand information transmitted to it from a DECT transmitter with which it has been or can be paired. A DECT receiver in the present context need not comply with the full DECT standard.

Preferably, the at least one listening device, such as a majority or all of the listening devices, of the system are adapted for being body worn. Further, the listening devices typically comprise a local source of energy (e.g. a battery, such as a rechargeable battery) for energizing the electronic components of the listening device, including the DECT receiver. In an embodiment, the local energy source is the only energy source of the listening device.

In an embodiment, the at least one listening device consists of one (separate) physical body housing the DECT receiver (and other functional units of the listening device) and is adapted for being worn at or in an ear or a user.

In an embodiment, the at least one listening device comprises more than one, separate physical body, e.g. a first ear worn part adapted for being mounted at or in an ear of a user AND a second body worn part adapted for being worn on the body of a user, e.g. hanging around the neck or mounted on clothing or otherwise fastened to the body of the user (e.g. on an arm or a leg). In an embodiment, the at least one listening device comprises a first part adapted for being located in an ear canal of a user (and e.g. comprising the output transducer)

and a second part adapted for being located outside the ear canal (e.g. behind the ear (pinna)) of a user (and e.g. comprising the DECT receiver), the first and second parts being e.g. in acoustic or electric communication with each other.

The term a 'separate physical body' is in the present context taken to mean 'a body having its own housing' so that 'two separate physical bodies' can be separated, each including a number of functional units, such as electronic and/or mechanical components. In an embodiment, 'two separate physical bodies' are—in an operational configuration—arranged to be in communication with each other, e.g. via electrical, acoustical or optical communication, be it wired or wireless.

In an embodiment, the listening device comprises an output transducer for presenting the audio signal to a user. In an embodiment, the output transducer and the DECT receiver of the listening device are located in the same physical part of the listening device. In an embodiment, the output transducer and the DECT receiver of the listening device are located in two different physical parts of the listening device.

In an embodiment, the output transducer comprises a receiver (loudspeaker) of an ordinary hearing aid. Alternatively, the output transducer comprises an electrode of a cochlear implant or a vibrator of a bone conducting hearing aid. In an embodiment, the listening device comprises an ordinary hearing aid (comprising a receiver/speaker as output transducer), a cochlear implant or a bone conducting hearing aid, an active ear protection device, an earphone, a headset or a combination thereof.

In an embodiment, at least a part of at least one listening device is adapted to be located at the ear, in the ear or in the ear canal of a user. Preferably, the receiving listening devices of the system comprise a part adapted to be located at the ear, in the ear or in the ear canal. Preferably, the receiving listening devices of the system are adapted to be located at the ear, in the ear or in the ear canal.

In general, the audio transmitting device can be connected to or form part of any audio source. In an embodiment, the audio transmitting device comprises or is connected to a microphone, a TV-set, a PC, a telephone or a dedicated base station, e.g. a gateway for a number of audio signals, or a combination thereof.

In an embodiment, the assistive listening system is adapted to provide that one or more corresponding channel and time slots of the DECT link intended for comprising the transmitted audio signal is/are allocated to the receiving listening device prior to (in advance of, e.g. right before) the start of the transmission of the audio signal or at a predefined condition (e.g. start-up of the receiving device or after an unintended loss of the connection).

In an embodiment, the assistive listening system comprises a slot controlling unit, wherein the receiving listening device is adapted to receive pairing information (authentication) and/or information about one or more corresponding channel and time slots of the DECT link intended for comprising the transmitted audio signal (from the slot controlling unit). In an embodiment, the slot controlling unit is separate from the audio transmitting device. Alternatively, the slot controlling unit is integrated with the transmitter. In an embodiment, the assistive listening system comprises only one slot controlling unit. In an embodiment, the assistive listening system is adapted to provide that the slot controlling unit transmits information about one or more corresponding channel and time slots of the DECT link intended for comprising the transmitted audio signal using radiated field transmission or via a near field coupling, e.g. an inductive coupling, between the slot controlling unit and the receiving listening devices. Alternatively, it may be based on a wired connection.

In an embodiment, the assistive listening system is adapted to provide that one or more corresponding channel and time slots of the DECT link intended for comprising the transmitted audio signal are allocated to the receiving listening device during a pairing process. In an embodiment, the assistive listening system is adapted to provide that the audio transmitting device and a receiving listening device are automatically paired when brought within a predefined distance of each other. In the Bluetooth 2.1 specification (cf. e.g. www.bluetooth.org), a so-called touch to pair feature based on near field communication according to the NFC standard is introduced. NFC=Near Field Communication is an open platform technology standardized in ECMA-340 and ISO/IEC 18092. Such pairing arrangement can e.g. be adapted to the present context.

In an embodiment, the receiving listening device is adapted to scan for the corresponding channel and time slot(s) comprising the transmitted audio signal under predefined conditions (e.g. during a pairing process, or when a reconnection of already paired devices is initiated, or after a power-up of the DECT receiver of the listening device). In an embodiment, the receiving listening device is adapted to scan for the corresponding channel and time slot(s) comprising the transmitted audio signal among a predefined set of one or more corresponding channel and time slots of the DECT link intended for comprising the transmitted audio signal. The (predefined set of) one or more corresponding channel and time slots of the DECT link intended for comprising the transmitted audio signal are e.g. provided in a list of preferred slots SL[1;N], where N is an integer indicating the number of slots in the list. This has the advantage of limiting the possibilities that has to be scanned before a suitable channel can be found. DECT uses dynamic channel allocation, each DECT channel (10 in Europe) having a carrier with a specific spacing (1 728 kHz in Europe). A receiver-scanning for specific predefined slots of the DECT link is e.g. performed by selecting the carrier frequency corresponding to the channel in question and checking whether the contents of relevant time slots of the channel are occupied with a signal that the receiver in question is authorized to receive.

In an embodiment, the assistive listening system is adapted to agree on an alternative channel and/or time slot of the DECT link for comprising the transmitted audio signal in case of interference on a primary channel and/or time slot. This can be achieved by initiating a (possibly renewed) scan process, preferably among the predefined set of possible slots/channels, or alternatively among all slots/channels (e.g. if none of the predefined slots/channels are available). Interference is an example of a 'predefined condition' that can lead to a scan for the corresponding channel and time slot comprising the transmitted audio signal.

In an embodiment, the transmitting device comprises a DECT transceiver (i.e. corresponding antenna and DECT transmitter and receiver circuitry), and the system further comprises a dummy unit comprising a DECT transceiver for providing feedback response to the DECT transceiver of the transmitting device.

In an embodiment, the DECT transmitter of the transmitting device is adapted to disregard or not require any feedback response from a DECT receiver. Such adaptation can e.g. be performed in the firmware of the DECT transmitter, cf. e.g. Chapter 8 in the ETSI EN 300 175-1 standard for DECT.

In an aspect, the assistive listening system comprises a transmitting device for transmitting an audio signal to a multitude of receiving listing devices, the system further comprising two or more receiving listening devices, e.g. five or more, such as ten or more listening devices. In an embodiment, the transmitting device (e.g. a microphone unit) comprises a DECT transceiver (i.e. corresponding antenna and DECT transmitter and receiver circuitry), and a dummy unit comprising a DECT transceiver for providing feedback response to the DECT transceiver of the transmitting device, the transmitting device being adapted to receive a signal from said dummy unit, and the system being adapted to establish a uni-directional digital link according to the DECT-standard from the audio transmitting device to the two or more receiving listening device.

A Method:

A method of operating an assistive listening system, the system comprising a transmitter for transmitting an audio signal and/or a control signal to a multitude of receiving listening devices and at least one receiving listening device adapted for receiving said audio signal and/or said control signal from said audio transmitting device is furthermore provided by the present invention. The method comprises providing that a digital link according to the DECT-standard is established from the audio transmitting device to the at least one receiving listening device and that said link is uni-directional.

It is intended that the structural features of the system described above, in the detailed description of 'mode(s) for carrying out the invention' and in the claims can be combined with the method, when appropriately substituted by a corresponding process. Embodiments of the method have the same advantages as the corresponding systems.

In an embodiment, the method comprises providing that one or more corresponding channel and time slots of the DECT link intended for comprising the transmitted audio signal is allocated to the receiving listening device prior to (in advance of, e.g. right before or alternatively in an initialization process, e.g. during start-up) the start of the transmission of the audio signal. In an embodiment, such list of predefined channels is transferred to the DECT receiver of the listening device during a pairing procedure, where the DECT receiver of the listening device is paired with (authorized to receive a signal from) the DECT transmitter of the transmitting device. In an embodiment, such list of predefined channels is transferred to the DECT receiver of the listening device by another unit than the transmitter. The pairing process comprises at least the transfer of an authentication information to the receiver allowing the receiver to decode (understand, extract information) the transmitted signal. The pairing process can be initialized from the transmitter or from an external unit (e.g. a slot control unit).

In an embodiment, the method comprises providing that the DECT receiver of a receiving listening device scans for the corresponding channel and time slot(s) comprising the transmitted audio signal from the DECT transmitter under predefined conditions. In an embodiment, such predefined conditions include a power-up of the DECT receiver of the listening device.

Use:

Use of an assistive listening system described above, in the detailed description of 'mode(s) for carrying out the invention' and in the claims is moreover provided by the present invention. In a preferred embodiment, use in connection with a public address system is provided. In a preferred embodiment, use in an educational environment, e.g. in a classroom or auditorium is provided. In a preferred embodiment, use in a concert environment is provided.

A Computer-Readable Medium:

A tangible computer-readable medium storing a computer program comprising program code means for causing a data processing system to perform at least some (such as a majority or all) of the steps of the method described above, in the detailed description of 'mode(s) for carrying out the invention' and in the claims, when said computer program is executed on the data processing system is furthermore provided by the present invention. In addition to being stored on a tangible medium such as diskettes, CD-ROM-, DVD-, or hard disk media, or any other machine readable medium, the computer program can also be transmitted via a transmission medium such as a wired or wireless link or a network, e.g. the Internet, and loaded into a data processing system for being executed at a location different from that of the tangible medium.

A Data Processing System:

A data processing system comprising a processor and program code means for causing the processor to perform at least some (such as a majority or all) of the steps of the method described above, in the detailed description of 'mode(s) for carrying out the invention' and in the claims is furthermore provided by the present invention. In an embodiment, the processor comprises an audio processor.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which:

FIG. 4 shows an embodiment of an assistive listening system comprising a transmitter adapted for transmitting a wireless signal comprising an audio signal from an audio source to a multitude of listening devices, and further comprising a dummy DECT transceiver for providing feedback (acknowledge) to the transmitter, FIG. 5 shows an embodiment of an assistive listening system comprising a transmitter adapted for transmitting a wireless signal comprising an audio signal from an audio source to a multitude of listening devices wherein the transmitter is adapted so that no feedback (acknowledge) is needed, FIG. 6 shows an embodiment of an assistive listening system comprising a transmitter adapted for transmitting a wireless signal comprising an audio signal from an audio source to a multitude of listening devices, and further comprising a dummy DECT transceiver for providing feedback (acknowledge) to the transmitter, wherein two slots are used for the transmission, FIG. 7 shows an embodiment of an assistive listening system comprising a transmitter adapted for transmitting a wireless signal comprising an audio signal from an audio source to a multitude of listening devices wherein the transmitter is adapted so that no feedback (acknowledge) is needed, and wherein two slots are used for the transmission.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

FIG. 1 shows embodiments of an assistive listening system comprising a transmitter (DECT TX) adapted for establishing a wireless link (One-way DECT) for transmitting a wireless signal comprising an audio signal according to the DECT standard from an audio source to a multitude of listening devices, here two (LD, DECT RX) forming part of a binaural fitting are shown, located at the ears of a User. The transmitter comprises a DECT transmitter (DECT TX) adapted for transmitting a wireless signal comprising an audio signal according to the DECT standard to a multitude of receivers (DECT RX). The listening device (LD) comprises a DECT receiver (DECT RX) adapted to receive a wireless signal comprising an audio signal according to the DECT standard from the transmitter (DECT TX). The DECT receiver can e.g. be integrated with other, such as the rest of the, functionality of the listening device. The DECT receiver can alternatively be housed in a separate physical body, e.g. directly electrically connectable to (e.g. clicked on, like an FM shoe, via a (standard) direct electric interface complying with the DECT standard) a housing comprising other (such as the rest of the) functionality of the listening device. Alternatively, the DECT receiver can be housed in a separate physical body electrically connected to an ear worn part of the listening device, e.g. by a wireless (cf. e.g. FIG. 3) or wired connection.

Figure 9:
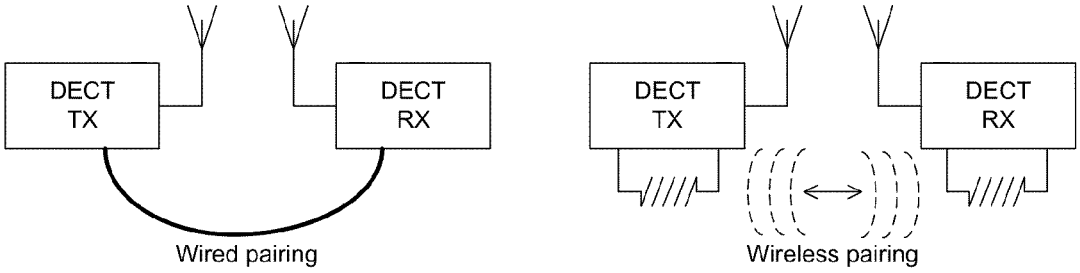
FIG. 9 shows the pairing between the transmitter and receiver(s) of an assistive listening system, the left part illustrating wired pairing, the right part illustrating wireless pairing (e.g. via an inductive link)

The DECT transmitter (DECT TX) and receiver(s) (DECT RX) are preferably paired according to a predefined initialization procedure (cf. e.g. FIG. 9) prior to establishing a link between them.

Figure 1A:
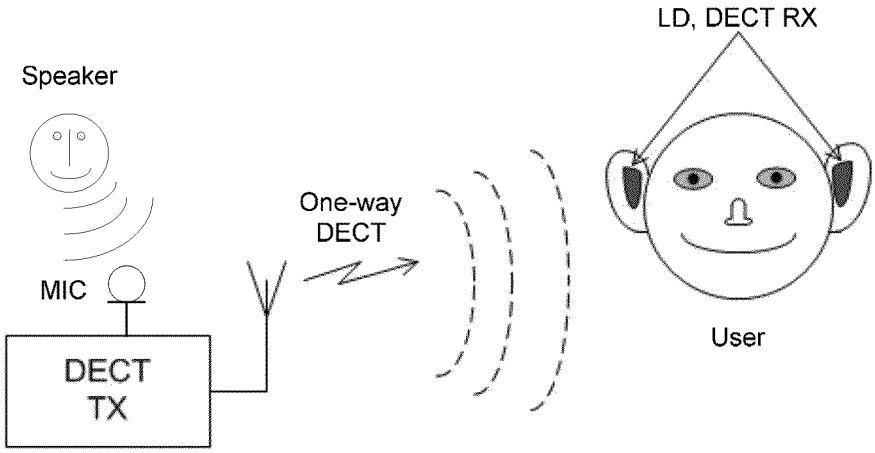
FIG. 1 shows embodiments of an assistive listening system comprising a transmitter adapted for transmitting a wireless signal comprising an audio signal from an audio source to a multitude of listening devices (here one is shown) located at the ear of a user, FIG. 1*a* showing a system where the audio source is a signal picked up by a microphone, FIG. 1*b* showing a system comprising a base station adapted for receiving a signal from a multitude of audio sources (microphone, TV, etc.) and for transmitting a wireless signal comprising an audio signal from one or more selected audio sources to the listening device(s), and FIG. 1*c* showing a system comprising a slot control unit for providing a list of preferred slots to the receiving listening devices.

FIG. 1*a* shows a system where the audio source is a signal picked up by a microphone MIC from a person (Speaker). The microphone is connected to a transmitter (DECT TX) by a wired or wireless connection (here a wired connection is indicated). The transmitter identifies an appropriate transmission channel and establishes a wireless link to the one or more listening devices (LD, DECT RX).

Figure 1B:
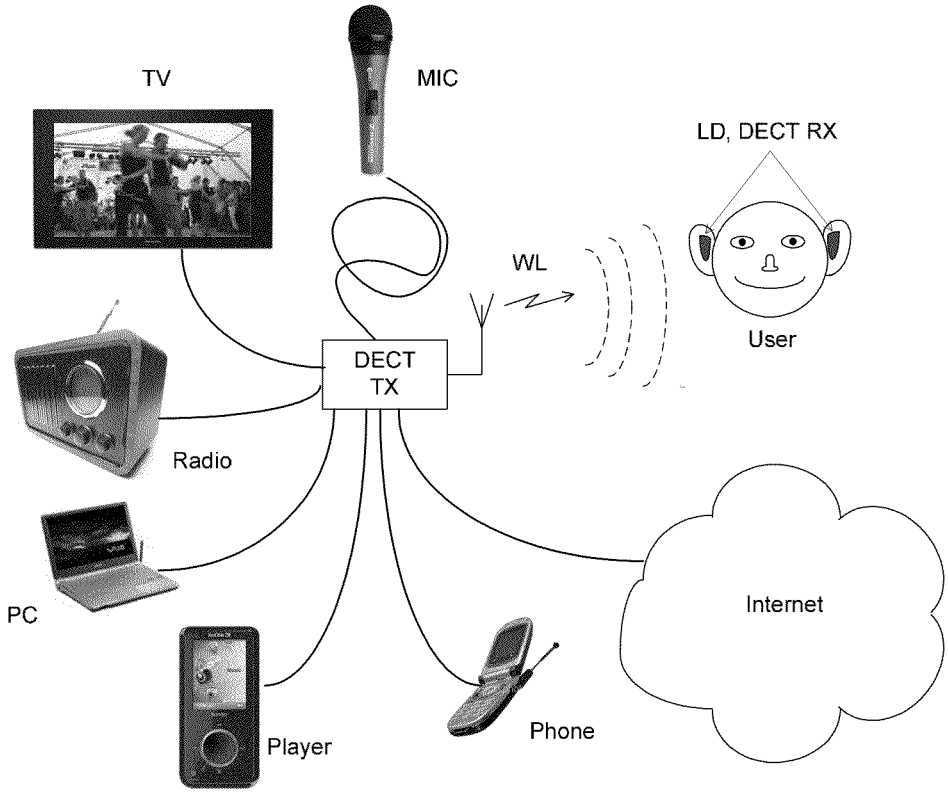

FIG. 1*b* shows a system comprising a base station DECT TX adapted for receiving signals from a multitude of audio sources (e.g. including one or more of a microphone (MIC), a TV-set (TV), a Radio, a Computer (PC), a music player (Player), a mobile telephone (Phone) or a landline phone, a network connection, e.g. to the Internet (Internet), etc.) and for establishing a wireless link WL for transmitting a wireless signal comprising an audio signal from one or more selected audio sources to the listening device(s) (LD, DECT RX) worn at the ears of a User. The audio sources are shown to be connected to the base station by wired connections. The connection to the base station may be wired or wireless depending on the individual audio source device.

Figure 1C:
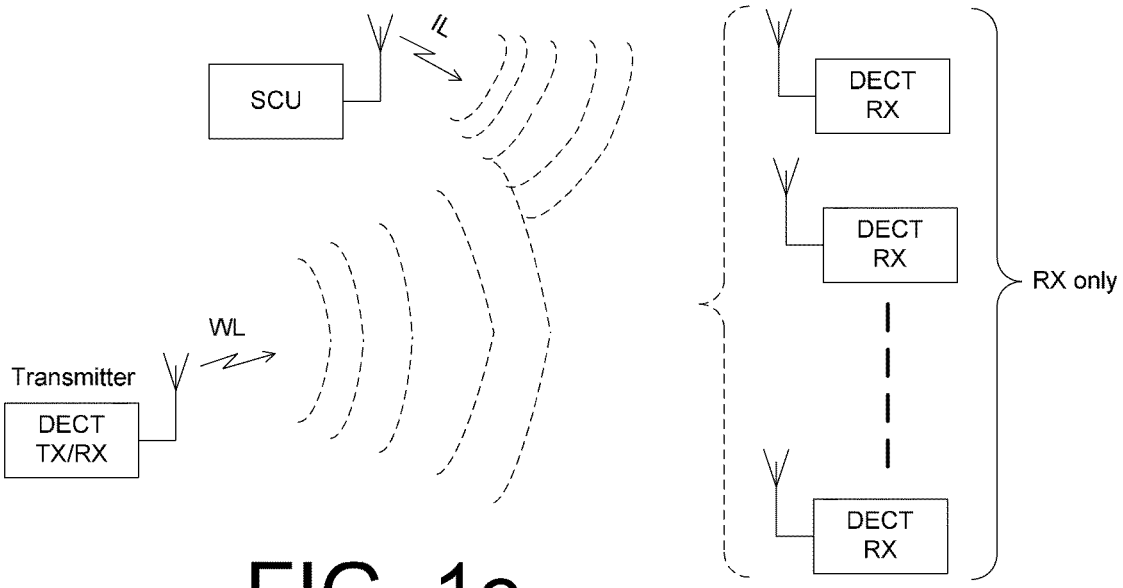

FIG. 1*c* shows an assistive listening system comprising transmitter DECT TX/RX adapted for establishing a wireless link WL for transmitting a wireless signal comprising an audio signal to a multitude of receiving listening devices, each receiving listening device comprising a DECT receiver DECT RX, the system further comprising a slot control unit SCU for providing a list of preferred slots to the receiving listening devices. The list of preferred slots SL[1;N], where N is an integer indicating the number of slots in the list, indicates the slots in the DECT map (cf. FIG. 2) that are intended for use for the transmission of the audio signal from the transmitter DECT TX/RX. The information on preferred slots is e.g. transmitted from the slot control unit SCU to the DECT receiver of the receiving listening devices using a wireless link, e.g. an inductive link IL. In a given application, e.g. an assistive teaching system for use in a classroom or an auditorium, one or more slot control units SCU (depending on the size of the room and the transmission range of the link) are located (e.g. fixedly mounted) in the room, so that a listening device comprising a DECT receiver (e.g. previously paired with the transmitter) located in or entering the room can be informed about the prevailing transmission channels of the transmitter. In an embodiment, the list of preferred slots is transmitted continuously so that newly entering listening devices can receive the information and tune the reception to such slots (i.e. possibly initiate a scanning). In an embodiment, the DECT receiver has to be powered down and then powered up while receiving the preferred slot list. In an embodiment, the list of preferred slots is transmitted on demand, e.g. initiated by an activation element on the SCU or via a remote control. Alternatively, the SCU can form part or be integrated with the DECT transmitter.

A listening device according to the present invention comprises e.g. a listening device located at the ear, in the ear or in the ear canal of a user, a Bone Anchored Hearing Aid (Baha), a Cochlear Implant (CI) sound processor and/or a body worn DECT receiver. The listening device comprises a receiver based on the DECT technology (cf. e.g. www.dect.org) or deviations of DECT such as DECT6.0 and CAT-iq plus future developments of the DECT technology. The following applications are e.g. envisioned:

1. Assistive listing devices for hearing impaired utilized in e.g. theatres, places of worship, museums, public meeting places, corporate conference rooms, convention centres, other large areas for gathering listening, classroom lecture, in a restaurant, in meetings, at hospitals, senior centre etc.
2. Studio and broadcast systems, e.g. working on stage, in front of a camera, etc.
3. Wireless tour guide systems.
4. Security systems.

DECT was developed by the European Telecommunications Standards Institute, ETSI (www.etsi.org) but has since been adopted by many countries all over the world. The original DECT frequency band (1880 MHz-1900 MHz) is used in all countries in Europe. Outside Europe, it is used in most of Asia, Australia and South America. In the United States, the Federal Communications Commission in 2005 changed channelization and licensing costs in a nearby band (1920 MHz-1930 MHz, or 1.9 GHz), known as Unlicensed Personal Communications Services (UPCS), allowing DECT devices to be sold in the U.S. with only minimal changes. These channels are reserved exclusively for voice communication applications and therefore are less likely to experience interference from other wireless devices such as baby monitors and wireless networks.

DECT devices made for use in the U.S. use the term DECT 6.0 to distinguish them from both DECT devices used elsewhere and U.S. cordless equipment operating in the 900 MHz, 2.4 GHz and 5.8 GHz ISM bands.

CAT-iq is the enhancement of DECT technology, promoting the standard to work with new emerging technologies. The CAT-iq standard defined protocols for the integration of Internet and telephony. CAT-iq is created by the DECT forum, and allows standard DECT systems to be used for VoIP (Voice over IP) and other Internet-based services, such as streaming audio and video.

DECT normally operates as a two way system utilizing a multicarrier Time Division Multiple Access/Time Division Duplex (TDMA)/(TDD) structure and uses/allows

- 10 carrier frequencies (5 in the US)
- a 1.7 MHz carrier spacing.
- 2.5 MHz bandwidth for improved range.
- maximum bandwidth of 2.5 MHz to support future technology innovation
- 24 TDM frames at each frequency (cf. FIG. 2)
  - 12 frames are used for up link/stream
  - 12 frames are used for down link/stream
- 10 ms TDM frame repetition.
- For a voice connection, each time slot contains 32 kBit/s data or 3.2 kHz voice information.

Figure 2:
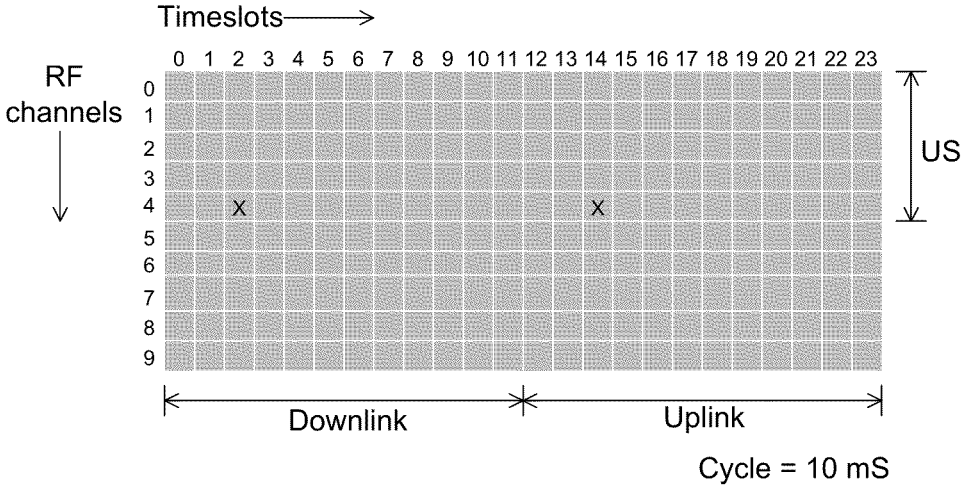
FIG. 2 shows an exemplary channel versus time slot map for a DECT link.

In theory up to 120 (60 in the US) 2-way DECT connection (3.2 kHz audio bandwidth or 32 kBit/s data in each slot) can take place at the time, see FIG. 2.

In practice headroom is needed for limitations in the electronics i.e. blind slots and synchronization mechanism are added, whereby the effective number of active links decreases.

Within the CAT-iq and DECT6.0 extensions wide band audio bandwidth (8 kHz) or higher connections are specified.

FIG. 2 shows an exemplary channel versus time slot map for a DECT link. The map of FIG. 2 corresponds to a Non-US DECT system comprising 10 carrier frequencies (i.e. 10 corresponding 'channels'. 0-9 RF-channels) and 24 time slots per TDM frame of 10 ms. Each time slot can contain a one way voice channel (e.g. 32 kBit/s data or 3.2 kHz voice information using two-level modulation; higher bitrates can be obtained with higher level modulation schemes, see e.g. Table 1 in ETSI EN 300 175-1 standard). The corresponding map for a US DECT system comprises the same number of time slots per frame, but only half the channels (i.e. channels 0-5, as indicated by the arrow denoted US in the top, right part of FIG. 2).

In the map of FIG. 2 the first 12 time slots (Time slots 0-11) of a frame are allocated to downlink transmission e.g. from a base station (transmitting device DECT-Tx of FIG. 1) to a mobile device (ear worn listening device of FIG. 1), whereas the last 12 time slots (Time slots 12-23) are allocated to uplink transmission (e.g. reception of signals in a base station from a mobile device).

The slots of a map are e.g. consecutively numbered from i=1 to i=240. Alternatively, a specific slot may be referenced by its channel index p (p=0, 1, . . . , 9) and its time slot index n (n=0, 2, . . . , 23). In an embodiment, a correspondence between the two numbering schemes is defined. In an embodiment, a downlink map is referenced by slot numbers i=1, 2, . . . , 120. In an embodiment, an uplink map is referenced by slot numbers i=121, 122, . . . , 240.

Figure 3:
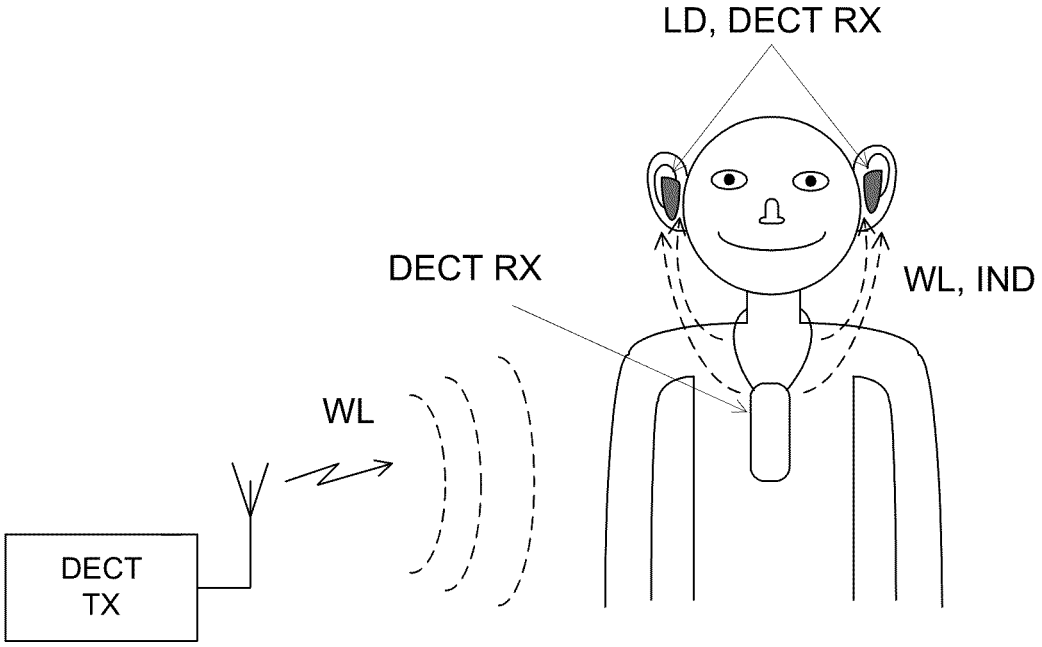
FIG. 3 shows an embodiment of an assistive listening system comprising a transmitter adapted for transmitting a wireless signal comprising an audio signal from an audio source to a multitude of listening devices (here one is shown) comprising a body worn part for receiving the wireless signal, extracting the audio signal and transmitting the audio signal to an ear piece located at an ear of a user.

FIG. 3 shows an embodiment of an assistive listening system comprising a transmitter (DECT TX) adapted for establishing a wireless link (WL) for transmitting a wireless signal comprising an audio signal from an audio source to a multitude of listening devices. In the embodiment of FIG. 3, a listening device is shown comprising two ear worn parts (EWP(IND RX)) and a body worn part (BWP(DECT RX, IND TX)). The body worn part BWP(DECT RX, IND TX) is adapted for receiving the wireless signal from the DECT transmitter, for extracting the audio signal from the wireless signal and for transmitting (via an inductive transmitter (IND TX)) an inductive wireless signal comprising the audio signal to the ear worn parts EWP(IND RX) located at an ear of a user. The ear worn parts EWP(IND RX) are each adapted to receive inductive wireless signal comprising the audio signal from the body worn part BWP via an inductive receiver IND RX. The ear worn parts are further adapted to extract the audio signal from the inductive wireless signal received by the inductive receiver IND RX and optionally for processing the audio signal (e.g. applying a frequency dependent gain, possibly according to a users' hearing profile), and for presenting the audio signal to a user.

The communication between the body worn and the ear worn part of the listening device can in general be of any kind be it electromagnetic (near field or far-field) or optic, but is preferably based on a wired connection or an inductive coupling between respective coils located in the body worn and ear worn parts. The inductive communication between the body worn and the ear worn part of the listening device can be arranged according to any appropriate standard or format, proprietary or public. Preferably, the communication is arranged via a near-field, inductive, digital, ultra-low power short range wireless link (WL, IND in FIG. 3). In a preferred embodiment, the communication between the body worn and the ear worn part is arranged according to a communication standard codec, such as G.722 (CCITT G.722 Wideband Speech Coding Standard, the CCITT G.722 wideband speech coding algorithm supporting bit rates of 64, 56 and 48 kbps). An example of such codec is given in (as e.g. described in US 2005/0255843 A1. Alternatively, other proprietary or public standards can be used. In an embodiment, the wireless link between the body worn and the ear worn part is uni-directional from the body worn to the ear worn part.

In a preferred embodiment, the system is adapted to provide a low-latency wireless link, such as a link having a delay from the transmitter to an ear worn part of the listening device the smaller than 30 ms, such as smaller than 20 ms, such as smaller than 10 ms. The delay can e.g. be decreased by minimizing overhead in the transmission protocol, avoiding or minimizing coding complexity, avoiding or minimizing buffering, and/or avoiding or minimizing error correction. Latency can be further minimized by utilizing downlink as well as uplink slots of the DECT map for transmission to the DECT receiver(s), cf. e.g. FIG. 8.

In the embodiment of an assistive listening system shown in FIG. 3, the body worn part of the listening device (denoted DECT RX in FIG. 3) can e.g. form part of a handheld telephone or another communication device, e.g. an audio gateway adapted for (wirelessly or wired) receiving a number of signals comprising audio signals (including a DECT-based audio signal) and for allowing a user to select one of the audio signals, and for transmitting the selected signal (e.g. the DECT signal or preferably an audio signal extracted from the DECT signal) to the ear worn part of the listening device. The coil of the body worn part can e.g. be a neck-loop, which at the same time allows the body worn part to be located around the neck or a user, sufficiently close to the ear worn part(s). Alternatively (or additionally), the body worn part comprises an inductive coil adapted for being coupled to a corresponding coil of the ear worn part (possibly via a neck loop coil, cf. e.g. WO 2008/125291 A2).

An advantage of the embodiment of FIG. 3 wherein the listening device comprises a body worn part comprising a DECT receiver is that the (one) DECT receiver of the body worn part can be used for both ear worn parts of the listening device.

Various embodiments of an assistive listening system are shown in FIG. 4-8. The systems all comprise a DECT transmitter (DECT TX) and a number of DECT receivers (DECT RX). The systems are adapted to establish a wireless link (WL) from the DECT transmitter to the number of DECT receivers. In an embodiment, the number of receivers adapted to receive an audio signal from the DECT transmitter via the DECT based wireless link (WL) is two or more, e.g. 5 or more, e.g. 10 or more, e.g. 25 or more. For each system one or more slots of the map illustrating channel versus time slots for a DECT frame (cf. FIG. 2) are indicated for implementing the wireless link in question. In FIG. 4, e.g., the slot defined by channel 3 and time slot 5 (marked by an encircled 'X' at the corresponding position in the map of FIG. 4) is used for implementing the transmission link from the DECT transmitter (DECT TX/RX) to the DECT receivers (DECT RX). Correspondingly, the slot defined by channel 15 and time slot 5 is used for implementing the transmission link from dummy transceiver (DECT RX/TX) to the DECT transmitter (DECT TX/RX).

DECT normally operates as a two way system, where each device comprises a DECT transmitter and receiver. The return link is (in a normal DECT two-way audio application) apart from transmitting audio signals used for synchronization and acknowledgement that the link is operable. However, a DECT based ALD system can e.g. be implemented either with a) a (e.g. one) dummy RX/TX unit to comply with the normal two way DECT standard; in such case, the units comprising only a DECT receiver just follow the receiving slot of the dummy RX/TX as depicted in FIG. 4, or b) the DECT transmitter can be modified to disregard or not require any feedback response as shown in FIG. 5.

The DECT transmitter, on the other hand, has to comply with the DECT standard. The modifications needed to the DECT transmitter to be able to dispense with a dummy DECT receiver to provide feedback (acknowledge) response in a DECT based ALD system include the use of the proprietary escapes routes within the DECT Common Interface (CI), cf. ETSI EN 300 175-1 standard, Chapter 8 concerning *Proprietary escapes within the CI*. Such modifications can be made in the firmware of the DECT transmitter. A standard, possibly firmware-modified, DECT transceiver including baseband can in principle be used in the listening devices. On the other hand, it might be advantageous to modify or customize the DECT receiver to focus the circuitry on parts required for reception and extraction of audio and control signals from the transmitted DECT signals (e.g. including transmitter-receiver synchronization measures). The 'DECT receiver' has to be able to receive the DECT signal form the transmitter but does not otherwise have to comply with the DECT standard. Because no transmission is needed from the listening devices (comprising the DECT receivers), the 'DECT receiver' does not need to comply with the part of the DECT standards concerning transmission, e.g. radiated electromagnetic energy, etc. and thus does not have to undergo standard DECT test procedures.

In case of high audio bandwidth including stereo, multiple DECT slots may be needed/required. FIG. 6 and FIG. 7 depict embodiments of an assistive listening system corresponding to the embodiments of FIG. 4 and FIG. 5, but where 2 DECT slots are needed. Alternatively more than two slots could be used.

Figure 8:
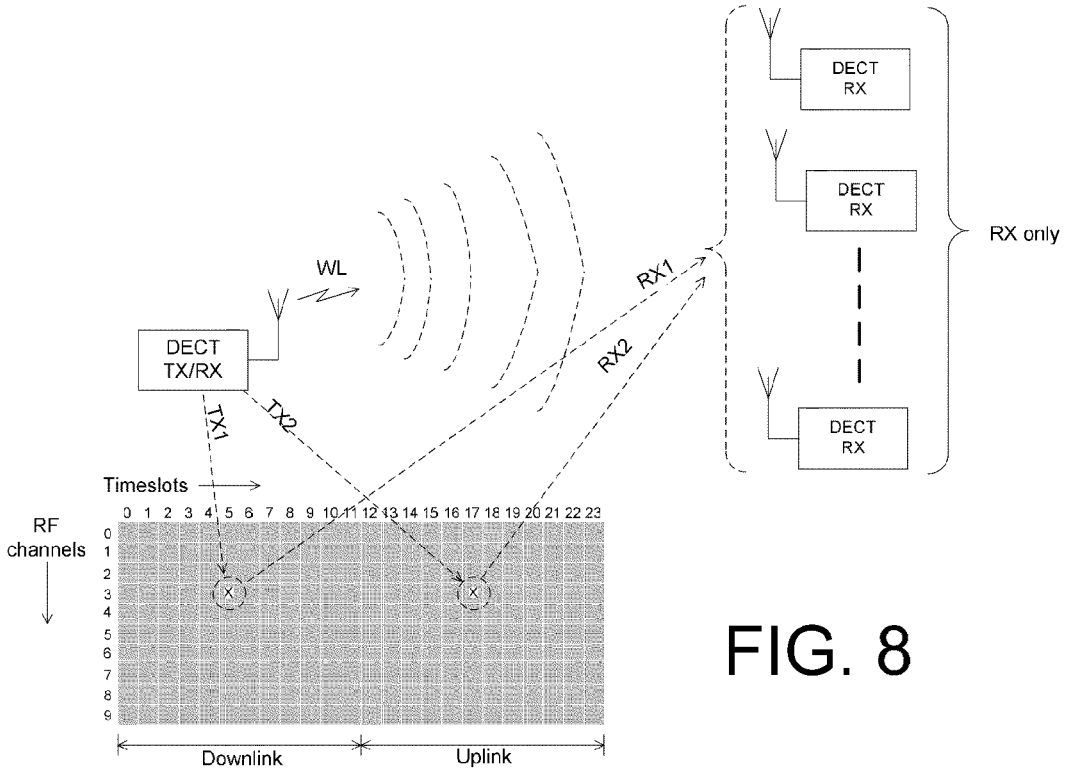
FIG. 8 shows an embodiment of an assistive listening system comprising a transmitter adapted for transmitting a wireless signal comprising an audio signal from an audio source to a multitude of listening devices the transmitter is adapted to utilize a slot in the downlink as well in the uplink part of the DECT channel vs. time slot map.

Within a system with a modified DECT transmitter, that disregards the feedback response from a matching DECT transceiver, the uplink time slot can be utilized to increase robustness of the system, i.e. the down link slot or slots can be repeated within the uplink slot(s), or the extra uplink slot(s) can be utilized for implementing a higher data rate e.g. audio bandwidth (or stereo or to minimize latency). This is illustrated in FIG. 8. In the map of FIG. 8, all 24 time slots (Time slots 0-23) are allocated to downlink transmission (from the transmitting device DECT TX/RX to the receiving devices DECT RX).

Subscription and authentication information channels are exchanged during pairing. An encrypted authentication code to allow a DECT receiver in question to receive messages from the transmitter is forwarded from the transmitter to the receiver during pairing. Further, a list of slots to consider (first) for availability at a given point in time (when setting up a link between the two devices) is forwarded from the transmitter to the receiver during pairing. Such list can e.g. be modified when a transmission is ongoing (if e.g. the transmitter identifies that slots on the list are occupied and/or previously occupied slots are becoming available). The pairing between the transmitter and the receiver(s) can be performed either wired or wirelessly—see FIG. 9. Wireless pairing can e.g. be performed by means of Near Field Communication (NFC, NFC is an open platform technology standardized in ECMA-340 and ISO/IEC 18092), by a proprietary magnetic communication protocol, or by RF communication such as Bluetooth (cf. www.bluetooth.org), ZigBee (cf. www.zigbee-.org) or any proprietary RF communication protocol.

Advantageously, a list of preferred communication slots is exchanged between the transmitter and receiver(s) during pairing. By means of the slot list, the receiver will find the transmitter faster during startup, in case of link loss, or if the link gets jammed or corrupted, see FIG. 10. Alternatively, the possible slots of the DECT map (cf. FIG. 2) can be scanned in a predefined order, e.g. for the downlink part by systematically scanning time slots 0 to 11 of each channel from channel 0 to 9. In an embodiment, total scanning time is in this mode limited to a predefined upper scan time.

Figure 10:
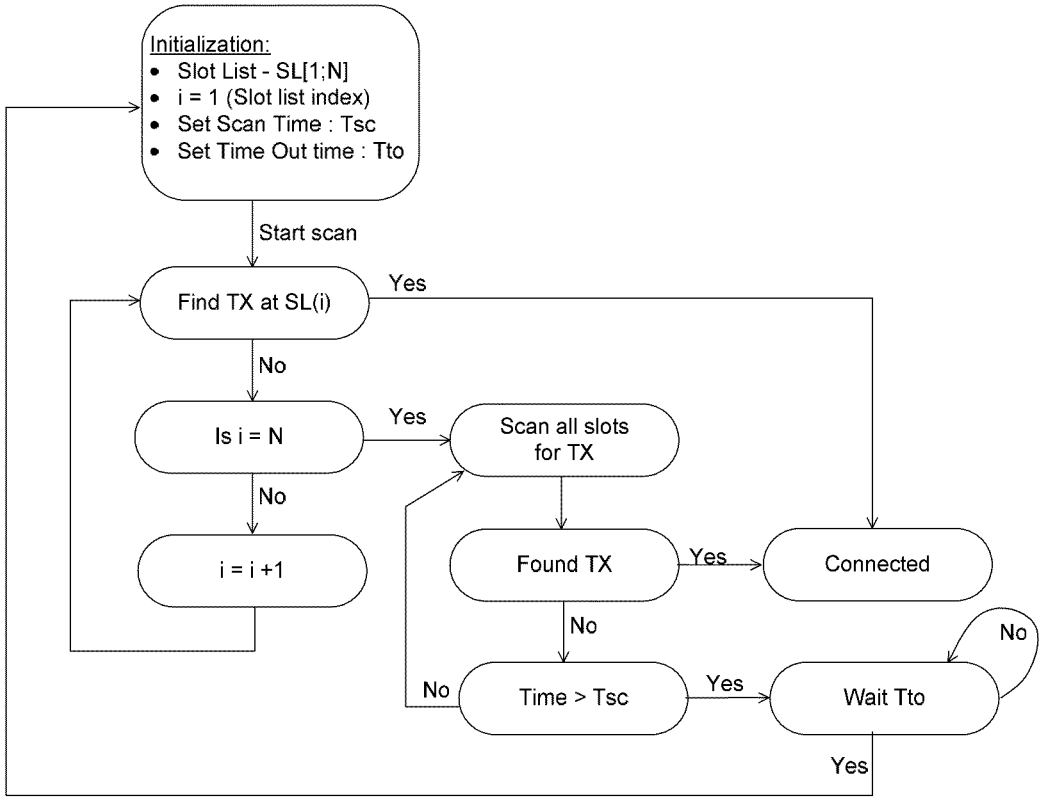
FIG. 10 shows a flow diagram for the initialization procedure for a DECT receiver of a receiving listening device for an assistive listening system.

FIG. 10 shows a flow diagram for the initialization of a DECT receiver DECT RX (e.g. after power-up of the receiver). The initialization procedure presumes a preceding pairing procedure wherein an authorization code (allowing the DECT receiver to receive information from the DECT transmitter in question) and a list of preferred slots SL[1;N], where N is an integer indicating the number of slots in the list. N is limited to 240, and is preferably smaller than 120, such as smaller than 10 or 5. The slots need not be located adjacent to each other but can be located anywhere in the map (cf. FIG. 2). In other words a slot list comprising 3 slots (N=3) may be constituted by slots defined by any three different combinations of channel numbers p=0 to 10 and time slot numbers n=0 to 11 (or 24), e.g. (p,n)=(2,4), (5,3) and (3,6) corresponding for example to i=1, 2 and 3, respectively. The initialization procedure comprises the following steps:

Step 1:
- Read the slot list SL[1;N] from a memory, the slot list comprising i=1, 2, . . . , N slots to scan, where N is the number of slots in the list;
- Set the slot index i to 1;
- Set the maximum total Scan Time Tsc;
- Set the Time Out time Tto;

Step 2:
- Start timer to monitor time.
- Start scan for slot i.
- If a transmission from the matching DECT transmitter is found, a CONNECTION is established.
- If not, go to Step 3.

Step 3:
- If i=N, go to Step 5.
- If not, go to Step 4.

Step 4:
- Increase i by 1 (i=i+1); go to Step 2.

Step 5:
- Start scan of next slot (in a predetermined or random order) among all slots.

Step 6:
- If a transmission from the matching DECT transmitter is found, a CONNECTION is established.
- If not, go to Step 7.

Step 7:
- If time >maximum total scan time Tsc, go to Step 8.
- If not, go to Step 5.

Step 8:
- If time >Time Out time Tto, go to Step 1.
- If not, remain in Step 8.

In an embodiment, the maximum total Scan Time Tsc is set to a value in the range from 1 s to 10 s, e.g. around 5 s. In an embodiment, the maximum Time Out time Tto is set to a value in the range from 10 s to 60 s or more.

The initialization procedure is e.g. used after a power-up of the DECT receiver of the listening device and/or under other predefined conditions. In an embodiment, the system is adapted to provide that the initialization procedure can be started by a user, e.g. via an activation element of the listening device (e.g. via a remote control).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

US 2005/0255843 A1 (Hilpisch et al.) Nov. 17, 2005

U.S. Pat. No. 6,397,037 B1 (AUDIOLOGICAL ENGINEERING) Dec. 10, 1998

WO 2009/118424 A2 (PHONAK) Oct. 1, 2009

WO 2006/074692 A1 (Von Ilberg) Jul. 20, 2006

WO 2008/125291 A2 (OTICON) Oct. 23, 2008

ETSI EN 300 175-1 Digital Enhanced Cordless Telecommunications (DECT); Common Interface (CI); Part 1: Overview. V2.2.1 (2008-11)

The invention claimed is:

1. An assistive listening system, comprising:

an audio transmitting device configured to transmit an audio signal and/or a control signal to a multitude of receiving listening devices, said audio transmitting device including a DECT transceiver;

at least one receiving listening device configured to receive said audio signal and said control signal from said audio transmitting device; and a dummy unit comprising a DECT transceiver for providing feedback response to the DECT transceiver of the transmitting device, wherein the system is configured to establish a digital DECT link according to DECT-standard from the audio transmitting device to the at least one receiving listening device, and the system is configured to provide that said link is unidirectional.

2. An assistive listening system according to claim 1, wherein at least a part of at least one listening device is configured to be located at the ear, in the ear or in the ear canal.

3. An assistive listening system according to claim 1 wherein the audio transmitting device comprises a microphone, a TV-set, a PC, a telephone or a dedicated base station, e.g. a gateway for a number of audio signals, or a combination thereof.

4. An assistive listening system according to claim 1, wherein one or more channel and time slots of the DECT link intended for comprising the transmitted audio signal is allocated to the receiving listening device prior to the start of the transmission of the audio signal.

5. An assistive listening system according to claim 1, further comprising:

a slot controlling unit, wherein the receiving listening device is configured to receive information about one or more channel and time slots of the DECT link intended for comprising the transmitted audio signal.

6. An assistive listening system according to claim 1, wherein one or more channel and time slots of the DECT link intended for comprising the transmitted audio signal are allocated to the receiving listening device during a pairing process.

7. An assistive listening system according to claim 1, wherein the receiving listening device is configured to scan for channel and time slot(s) comprising the transmitted audio signal under predefined conditions.

8. An assistive listening system according to claim 7, wherein the receiving listening device is configured to scan for the channel and time slot comprising the transmitted audio signal among a predefined set of one or more channel and time slots of the DECT link intended for comprising the transmitted audio signal.

9. An assistive listening system according to claim 1, wherein the DECT transmitter of the transmitting device is configured to disregard or not require any feedback response from a DECT receiver.

10. An assistive listening system according to claim 1 wherein the transmitted signal comprises an audio signal and a control signal, which are transmitted via the uni-directional link.

11. A method of operating an assistive listening system, which includes an audio transmitting device for transmitting an audio signal and/or a control signal to a multitude of receiving listening devices and at least one receiving listening device configured to receive said audio signal and/or said control signal from said audio transmitting device, the method comprising:

establishing a digital link according to DECT-standard from the audio transmitting device to the at least one receiving listening device, said digital link being uni-directional; and providing feedback response from a DECT transceiver of a dummy unit of the assistive listening system to a DECT transceiver of the audio transmitting device.

12. A method according to claim 11, further comprising:

providing that one or more channel and time slots of the DECT link intended for comprising the transmitted audio signal is allocated to the receiving listening device prior to the start of the transmission of the audio signal.

13. A method according to claim 11, further comprising:

providing that a DECT receiver of a receiving listening device scans for channel and time slot(s) comprising the transmitted audio signal from the DECT transceiver of the audio transmitting device under predefined conditions.

14. A tangible non-transitory computer-readable medium encoded with instructions, wherein the instructions when executed on a processor of an assistive listening system that includes an audio transmitting device for transmitting an audio signal and/or a control signal to a multitude of receiving listening devices and at least one receiving listening device configured to receive said audio signal and/or said control signal from said audio transmitting device, cause the assistive listening system to perform a method comprising:

establishing a digital link according to DECT-standard from the audio transmitting device to the at least one receiving listening device, said digital link being uni-directional; and providing feedback response from a DECT transceiver of a dummy unit of the assistive listening system to a DECT transceiver of the audio transmitting device.

15. A data processing system comprising a processor and program code means for causing the processor to perform the steps of the method of claim 11.

16. An assistive listening system, comprising:

an audio transmitting device for transmitting an audio signal to a multitude of receiving listening devices, the audio transmitting device comprising a DECT transceiver;

two or more receiving listening devices;

a dummy unit comprising a DECT transceiver for providing feedback response to the DECT transceiver of the audio transmitting device, wherein the audio transmitting device is configured to receive a signal from said dummy unit, and the system is configured to establish a uni-directional digital link according to DECT-standard from the audio transmitting device to the two or more receiving listening devices.

17. An assistive listening system, comprising:

an audio transmitting device, the audio transmitting device configured to transmit an audio signal and/or a control signal to a plurality of receiving listening devices; and at least two receiving listening devices configured to receive said audio signal and/or said control signal from said audio transmitting device, wherein the assistive listening system is configured to establish a digital DECT link according to DECT-standard from the audio transmitting device to the at least two receiving listening devices, the assistive listening system is configured to provide that said digital DECT link is uni-directional, and said digital DECT link uses same channel and same time slot for transmission of said audio signal from the audio transmitting device to each of the at least two receiving listening devices.

18. The assistive listening system according to claim 17, wherein the audio transmitting device includes a DECT transceiver, and the assistive listening system further comprises a dummy unit including a DECT transceiver configured to provide feedback response to the DECT transceiver of the audio transmitting device.

19. A method of operating an assistive listening system which includes an audio transmitting device for transmitting an audio signal and/or a control signal to a plurality of receiving listening devices, and at least two receiving listening devices configured to receive said audio signal and/or said control signal from said audio transmitting device, the method comprising:

establishing a digital link according to DECT-standard from the audio transmitting device to the at least two receiving listening devices, said digital link being uni-directional; and using same DECT channel and same DECT time slot in said digital link for transmission of said audio signal from the audio transmitting device to each of the at least two receiving listening devices.

20. The method according to claim 19, further comprising:

providing feedback response from a DECT transceiver of a dummy unit of the assistive listening system to a DECT transceiver of the audio transmitting device.

* * * * *